US011454011B2

(12) United States Patent
Bomatter et al.

(10) Patent No.: US 11,454,011 B2
(45) Date of Patent: Sep. 27, 2022

(54) CONNECTING ELEMENT FOR FASTENING A SINK TO A WORKTOP

(71) Applicant: Franke Technology and Trademark Ltd, Hergiswil (CH)

(72) Inventors: Christian W. Bomatter, Willer (FR); Rolf Neeser, Reidermoos (CH)

(73) Assignee: Franke Technology and Trademark Ltd, Hergiswil (CH)

( * ) Notice: Subject to any disclaimer, the term of this patent is extended or adjusted under 35 U.S.C. 154(b) by 0 days.

(21) Appl. No.: 17/268,662

(22) PCT Filed: Jul. 12, 2019

(86) PCT No.: PCT/EP2019/068785
§ 371 (c)(1),
(2) Date: Feb. 16, 2021

(87) PCT Pub. No.: WO2020/035235
PCT Pub. Date: Feb. 20, 2020

(65) Prior Publication Data

US 2021/0172160 A1 Jun. 10, 2021

(30) Foreign Application Priority Data

Aug. 15, 2018 (DE) ..... 102018119845.0

(51) Int. Cl.
*E03C 1/33* (2006.01)

(52) U.S. Cl.
CPC ..... *E03C 1/33* (2013.01)

(58) Field of Classification Search
CPC ..... E03C 1/33
USPC ..... 4/633
See application file for complete search history.

(56) References Cited

U.S. PATENT DOCUMENTS 3,034,144 A * 5/1962 Albert ..... E03C 1/335 4/634
5,664,265 A * 9/1997 Gotter ..... E03C 1/335 4/631
8,944,044 B2 * 2/2015 Buck ..... F24C 15/108 248/500
10,550,558 B2 * 2/2020 Cagliari ..... E03C 1/33
(Continued)

FOREIGN PATENT DOCUMENTS

AT 393075 1/1991
AT A246889 1/1991
(Continued)

*Primary Examiner* — Christine J Skubinna
(74) *Attorney, Agent, or Firm* — Volpe Koenig

(57) ABSTRACT

A connecting element (1) is provided for fastening a sink (10) to a worktop (20), which worktop has a cutout (21) for inserting the sink, which cutout has a peripheral boundary surface (22). The connecting element has: a base body (2) serving as a bearing part for bearing against the sink; at least one spring part (3.1-3.8) which projects from the base body on a first side and which is designed, under loading in the direction of the base body, to produce a spring force which acts away from the base body; and at least one anchoring part which projects from the base body on a second side thereof situated opposite to the first side and which is designed to engage in a slot-shaped recess (15) in the sink. An engagement direction of the anchoring part extends substantially approximately antiparallel to a direction of the spring force.

17 Claims, 6 Drawing Sheets

(56) References Cited

U.S. PATENT DOCUMENTS

| | | | | |
|---|---|---|---|---|
| 2005/0039254 | A1 | 2/2005 | Brown | |
| 2007/0151019 | A1* | 7/2007 | Marr | E03C 1/33 4/633 |

FOREIGN PATENT DOCUMENTS

| | | |
|---|---|---|
| DE | 2064248 | 4/1972 |
| DE | 4439906 | 11/1995 |
| DE | 102009033523 | 1/2011 |
| EP | 2602555 | 6/2013 |
| EP | 2607794 | 6/2013 |

* cited by examiner

CONNECTING ELEMENT FOR FASTENING A SINK TO A WORKTOP

TECHNICAL FIELD

The invention relates to a connecting element for fastening a sink to a worktop, which worktop has a cutout for inserting the sink, which cutout has a peripheral boundary face.

Furthermore, the invention relates to a combination of a sink with at least one connecting element according to the invention arranged on the sink.

BACKGROUND

In order to install sinks, in particular kitchen sinks, made of a molded material, in particular a mineral molded material (a plastic molded material or combinations thereof) it is known to provide the sink with a slot laterally in the region of reinforcement structures which project from its underside, into which slot a screw securing claw engages with a suitable anchoring projection. Then, by means of a screw which has to be acted on from underneath the worktop, a clamp part is moved from below into abutment against the worktop, in order to secure the sink on the worktop. A disadvantage with such a solution is that it can be used only for a limited range of worktop thicknesses, because the specified clamp part has to interact with the worktop from below. Furthermore, the use of a screw which has to be tightened from underneath the worktop entails increased expenditure on mounting.

SUMMARY

The invention is based on the object of specifying a connecting element for fastening a sink to a worktop, which connecting element can be used for, as it were, any worktop thicknesses and requires only reduced expenditure on mounting. The connecting element to be provided is to be advantageously suitable for use with (kitchen) sinks which are produced from a plastic molded material, a mineral molded material or a corresponding composite material.

The object of the present invention is also to specify a combination of a sink and such a connecting element.

This object is achieved according to the invention by a connecting element for fastening a sink to a worktop having one or more of the features described herein, and by a combination of a sink and a connecting element which is arranged on the sink.

Advantageous developments of the inventive concept are described below and in the claims.

According to the invention, a connecting element for fastening a sink to a worktop, which worktop has a cutout for inserting the sink, which cutout has a peripheral boundary face, has the following features: a base body which serves as a bearing part for bearing against the sink; at least one spring part which projects from the base body on a first side and which is designed to bring about a spring force which acts away from the base body, when there is loading in the direction of the base body; and at least one anchoring part which projects from the base body on a second side thereof lying opposite the first side and which is designed to engage in a slot-shaped recess in the sink; wherein an engagement direction of the anchoring part (in the specified recess) extends essentially approximately antiparallel with respect to a direction of the spring force.

A combination according to the invention of a sink and at least one connecting element which is arranged on the sink is distinguished by the fact that the connecting element is embodied as a connecting element according to the invention.

According to the invention there is provision that instead of the previously known screw elements a connecting element is used which can ensure particularly frictionally locking fastening of the sink to a worktop due to a spring force which is conveyed by the spring part. The securing of the connecting element itself to the sink is carried out by the anchoring part which is designed to engage in a slot-shaped recess in the sink. In this context, there is also provision that an engagement direction of the anchoring part (in the slot-shaped recess in the sink) extends essentially approximately antiparallel with respect to a direction of the spring force, so that when the sink is fastened to the worktop using the connecting element, it is at the same time ensured that the connecting element is reliably secured to the sink.

Wherever it is stated here and below that the engagement direction of the anchoring part is intended to extend "essentially" approximately antiparallel with respect to a direction of the spring force, this includes configurations in which an angle between the engagement direction and the direction of the spring force is at least approximately 135° or 225° and preferably at least approximately 150° or 210°. It is therefore not necessary for the engagement direction and spring force direction to be oriented actually precisely antiparallel. Reference is also made to this in more detail below.

Another development of the connecting element according to the invention provides that the spring part is embodied as a tongue which projects from the base body in an edge region of the base body and which has a first extent section adjoining the edge region and a second extent section adjoining the first extent section, wherein the tongue in the first extent section extends approximately perpendicularly with respect to the base body, and in the second extent section extends approximately parallel to or at an acute angle of less than 45 degrees, preferably less than 30 degrees, with respect to the base body.

In this way it is possible to bend back the spring part tongue in the region of the second extent section in the direction of the base body, as a result of which the spring force (restoring force) which has already been mentioned is produced. By adapting or changing the specified angle it is possible, in particular, to compensate tolerances during the production of the worktop cutout.

In order to improve further the fastening effect of the connecting element, it has proven advantageous if the spring part also has a further, third extent section which adjoins the second extent section and in which the spring part is angled to a greater extent from the base body than in the second extent section.

In order to improve the securing effect even further, in one development of the connecting element according to the invention there can be provision that the spring part is widened in the third extent section at least in certain areas with respect to the second extent section.

Moreover, according to another development of the connecting element according to the invention, the spring part can also have a widened portion at least in certain areas in the second extent section. As a result, in particular the stability of the spring part itself can be increased.

According to yet another development of the connecting element according to the invention there can be provision that said connecting element has a multiplicity of spring parts which preferably differ with respect to the angle between the base body and the sum in the second extent section and/or with respect to a length of the third extent section. Additionally, as a result, tolerances, in particular of the worktop cutout, can be effectively compensated and the fastening effect improved.

With respect to the anchoring part it is possible to provide, according to another development of the connecting element according to the invention that said anchoring part is embodied as a tongue which projects from the base body in an edge region of the base body and which has a first extent section which adjoins the edge region, and a second extent section which adjoins the first extent section, wherein the tongue in the first extent section extends away from the base body, approximately perpendicularly with respect thereto, and in the second extent section extends back again to the base body.

In this way, effective securing of the connecting element in the slot-shaped recess in the sink can be achieved, wherein the securing effect can also be improved by virtue of the fact that an effective width of the anchoring part is at least slightly larger in the region of the first and second extent sections than a corresponding width of the slot-shaped recess. Due to the bending back of the anchoring part in the region of the second extent section said anchoring part is made flexible in the specified region and therefore when it is introduced into the slot-shaped recess in the sink it can correspondingly deform (elastically).

The securing effect can also be improved by virtue of the fact that according to another development of the connecting element according to the invention the anchoring part tongue has at its free edge positioned at the end an incision or a notch. In this way, points on the anchoring part tongue which can dig into the material of the sink are produced in the region of the abovementioned free edge positioned at the end. It is therefore not readily possible to remove an inserted connecting element again without damage.

According to one particularly preferred development of the connecting element according to the invention there can be provision that it has a multiplicity of anchoring parts which preferably differ with respect to an angle between the first extent section and the second extent section and/or with respect to a dimension of the first extent section. This improves the anchoring effect.

It has proven advantageous if the connecting element according to one corresponding development of the invention is produced as a punched-bent part or a laser cut part from a metallic material, preferably steel, most preferably stainless steel. In this way, the connecting element has the necessary stability and stability in use, in particular in a possibly damp environment.

According to another development of the connecting element according to the invention there can also be provision that the latter has at least one clip which projects over the rest of the base body, preferably in the width direction, on the base body, preferably positioned at the end. This clip/these clips can be useful for the production of the connecting element and can serve, for example, to secure the connecting element during production.

Furthermore, according to another configuration of the connecting element according to the invention there can be provision that at least one breakthrough is provided in the base body, preferably in the region of the abovementioned clip. This breakthrough can serve for centering the connecting element during its production and for conveying it on.

The specified clips are generally not relevant for the fastening of the connecting element to the sink but they can be useful during mounting.

In one development of the combination according to the invention there can be provision that the sink has, on its mounting underside, at least one anchoring and bearing structure positioned on the edge and having a bearing face which extends at an angle of approximately 90 degrees with respect to a bearing edge of the sink, and having a slot-shaped recess in the bearing face, which recess extends parallel to the bearing edge and is designed and provided for receiving the anchoring part. In the region of the abovementioned bearing edge, in the mounted state the sink is located on top of the worktop. The specified anchoring and bearing structure is then located in the region of the cutout in the worktop, adjacent to the boundary face thereof.

The abovementioned angle is not limited to values of precisely 90° but rather can deviate therefrom in a certain tolerance range. For example, such a deviation of approximately 5°, approximately 10° or approximately 15° has proven expedient. The anchoring and bearing structure then has a frustrum-shaped configuration in cross section, which, in particular, when the sink is produced from a molded material, can facilitate the removal from the mold.

In yet another development of the combination according to the invention there can be provision that the connecting element bears with the base body against the bearing face when the anchoring part is received in the recess, wherein the spring part projects outward away from the sink. Correspondingly, an angle between the base body and anchoring part should therefore be adapted to the abovementioned angle in the region of the bearing face of the anchoring and bearing structure. In this way, the connecting element can be effectively supported over a surface on the anchoring and bearing structure and therefore exert its fastening effect to an optimum extent.

It has already been pointed out that according to one preferred development of the combination according to the invention the anchoring and bearing structure can be embodied in the form of a frustrum in cross section.

Additionally or alternatively, in another development of the combination according to the invention there can be provision that an anchoring and bearing structure is provided on both long sides and/or short sides of the sink. It has proven to be particularly advantageous to provide corresponding anchoring and bearing structures only on the two long sides of the sink. However, it lies within the scope of the invention to provide a corresponding anchoring and bearing structure on at least one of the two short sides of the sink, preferably on a side of the sink facing away from a sink basin.

It has also already been pointed out that within the scope of a corresponding configuration of the combination according to the invention, the sink, preferably the sink including the anchoring and bearing structure, which can be embodied in one piece with the sink, can be produced from a plastic molded material, a mineral molded material or a corresponding composite material. Such sinks are esthetically attractive and particularly durable in terms of their fatigue strength and stability.

Finally, in one development of the combination according to the invention there can also be provision that this combination additionally also comprises a worktop, which worktop has a cutout for inserting the sink, which cutout has a peripheral boundary face, with which boundary face the connecting element interacts with the spring part in order to attach the sink. The specific configuration of the anchoring elements serves to securely fasten the connecting element in the slot-shaped recess in the sink. Due to the described configuration, the connecting element can be easily inserted into the specified slot, e.g. by pushing it in laterally, but cannot be readily removed again therefrom. Removing the connecting element (violently) from the slot using a tool would damage the connecting element and therefore make it unusable.

BRIEF DESCRIPTION OF THE DRAWINGS

Further properties and advantages of the invention emerge from the following description of exemplary embodiments with reference to the drawing, in which.

DETAILED DESCRIPTION

Figure 1:
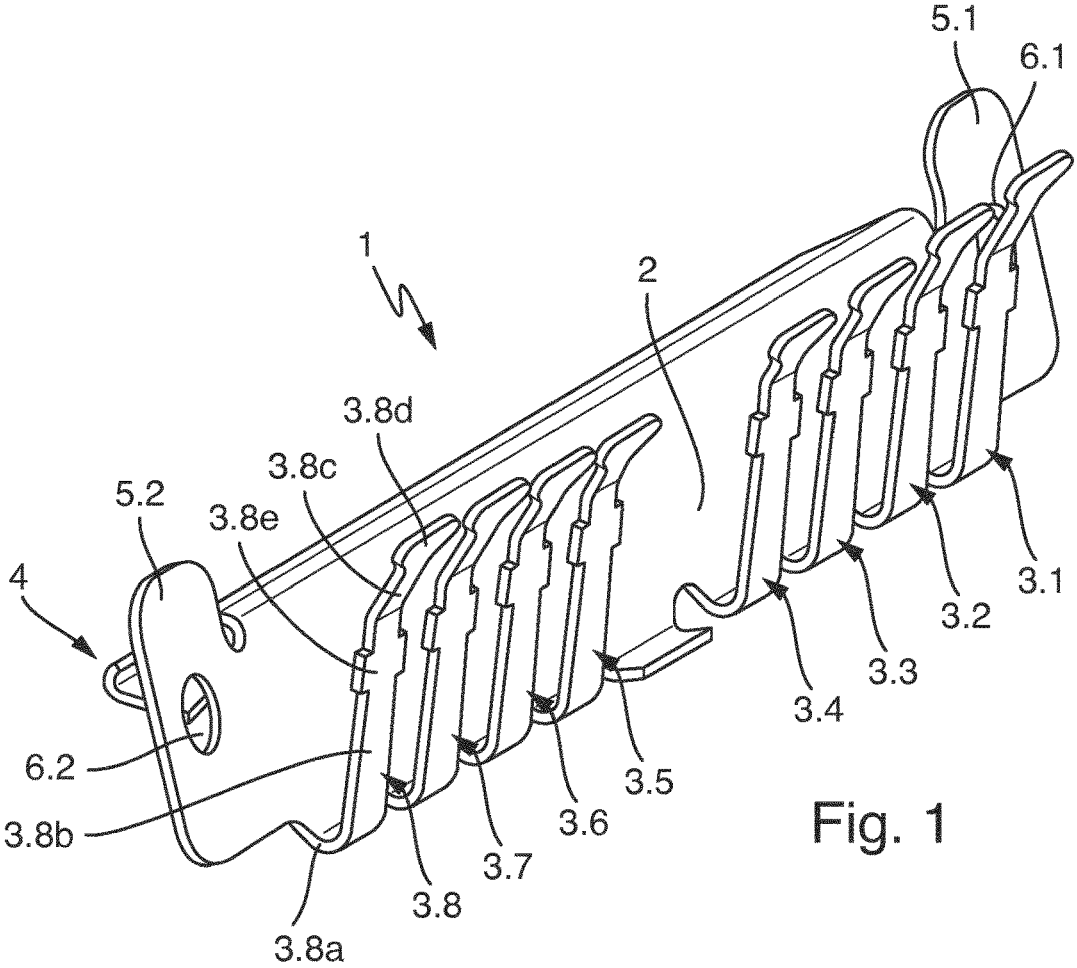
FIG. 1 shows a perspective illustration of a connecting element according to the invention for fastening a sink to a worktop.

FIG. 1 shows a perspective view of a possible configuration of the connecting element according to the invention for fastening a sink to a worktop. The connecting element is referred to in FIG. 1 in its entirety by the reference symbol 1. It is advantageously produced as a punched-bent part from a metallic material, preferably from stainless steel. The connecting element 1 has: a base body 2 which serves as a bearing part for bearing against a sink (not shown in FIG. 1). More details are given on this below. Furthermore, at least one spring part which projects from the base body 2 on a first side. FIG. 1 illustrates eight such spring parts which are correspondingly referred to by the reference symbol 3.1-3.8. The spring parts 3.1-3.8 are designed to bring about, when there is loading in the direction of the base body 2, a spring force which acts away from the base body 2. Furthermore, at least one anchoring part 4, which projects from the base body 2 on a second side of said base body 2 lying opposite the first side of the base body 2, and is designed at least to engage in a slot-shaped recess in the sink, more details of which are given further below. In the illustration according to FIG. 1, just one such anchoring part 4 can be seen in a rudimentary form. For a more precise illustration, reference is made to FIG. 2.

Figure 2:
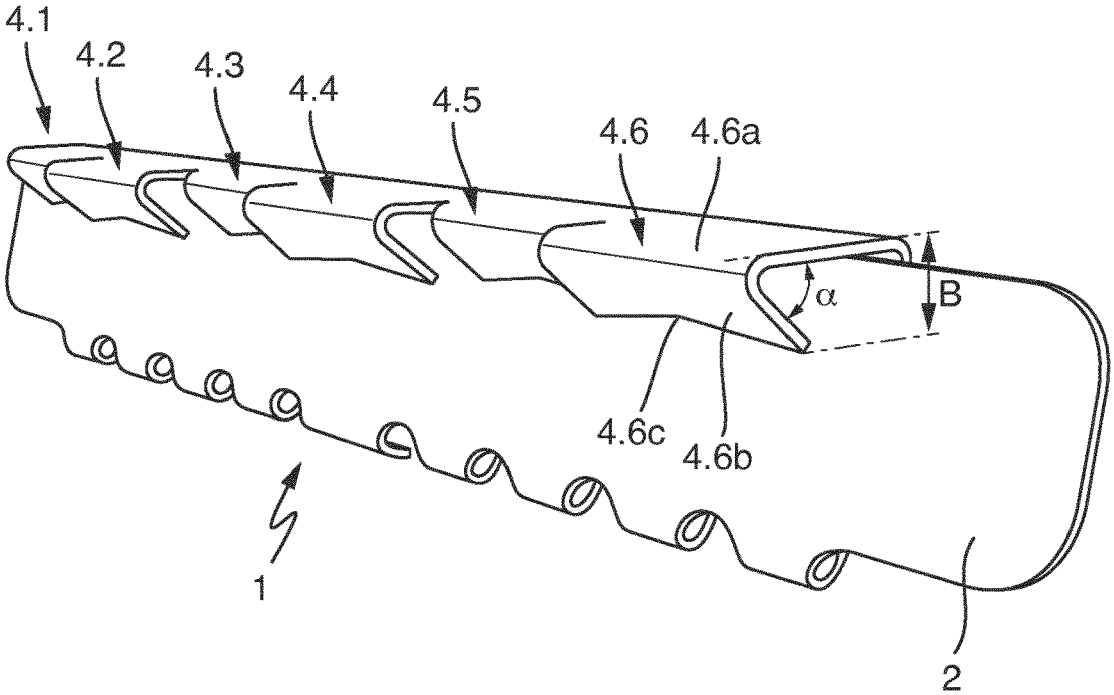
FIG. 2 shows a perspective illustration of a somewhat different configuration of the connecting element according to the invention.

FIG. 2 shows a view of the specified second side (rear side) of the base body 2, as a result of which it can be seen that instead of just one anchoring part actually six anchoring parts 4.1-4.6 are provided and are correspondingly labelled in FIG. 2.

On the base body 2, the connecting element according to FIG. 1 has clips 5.1, 5.2 which are positioned at the ends and project over the rest of the base body 2, in particular in its width direction. In the region of these clips 5.1, 5.2 there is in each case one circular breakthrough 6.1, 6.2 provided.

As is clearly apparent from FIG. 2, the configuration shown there does not have any such clips or breakthroughs. However, it is within the scope of the invention also to provide such clips/breakthroughs in the embodiment illustrated in FIG. 2. Likewise, in the embodiment shown in FIG. 1 it is also possible to dispense with the specified clips 5.1, 5.2 and breakthroughs 6.1, 6.2.

Figure 3:
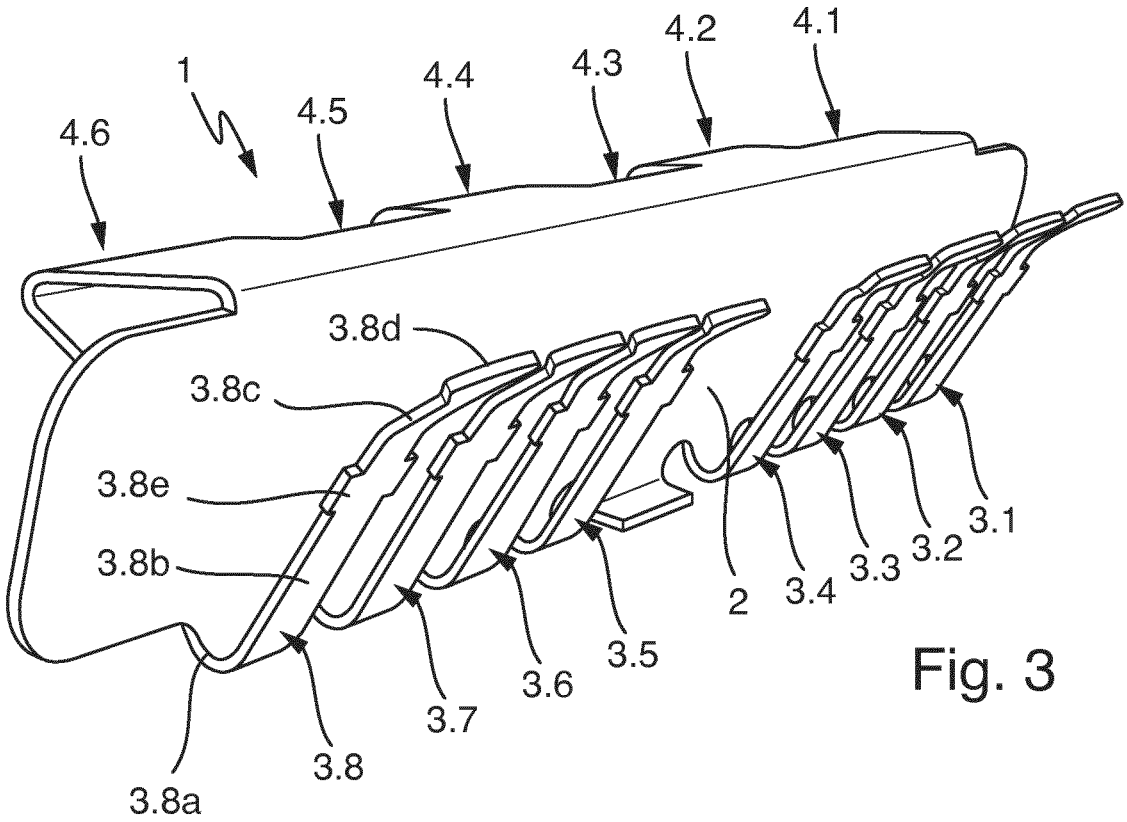
FIG. 3 shows a perspective illustration of a different view of the connecting element from FIG. 2.

A corresponding configuration is shown in FIG. 3, which is an illustration of the other side (front side) of the connecting element 1 according to FIG. 2. Otherwise, the configuration of the connecting element 1 according to FIG. 3 corresponds to the configuration of the connecting element 1 according to FIG. 1.

Figure 4:
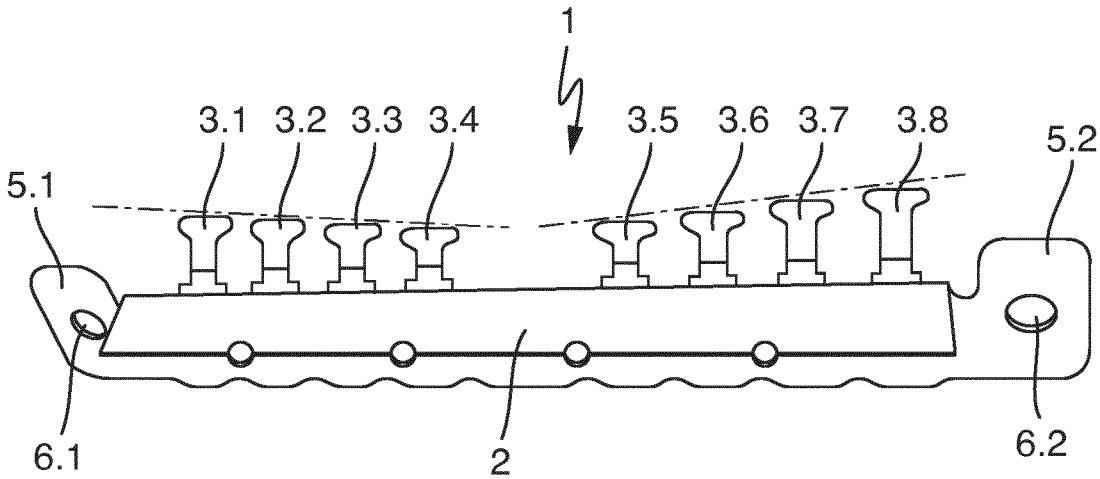
FIG. 4 shows a schematic plan view of the connecting element according to FIG. 1.

FIG. 4 shows a somewhat different illustration of the connecting element 1 according to FIG. 1, in order to clarify that the individual spring parts 3.1-3.8 have different lengths of extent away from the base body 2. This is clarified in FIG. 4 by the two dot-dash lines which each illustrate a type tangent to the spring parts 3.1 to 3.4 and 3.5 to 3.8. Details will now be given by way of example on the corresponding structural configuration of the spring parts 3.1-3.8 with reference to FIG. 1.

Each spring part 3.1-3.8 is embodied as a tongue projecting from the base body 2 in an edge region of the base body 2. Each of these tongues firstly has a first extent section 3.8*a*, which is adjoined by a second extent section which is referred to by the reference symbol 3.8*b* in FIG. 1. In this context, the tongue extends into the first extent section 3.8*a* approximately perpendicularly with respect to the base body 2, and in the second extent section 3.8*b* extends approximately parallel or at a relatively acute angle of less than 45°, preferably less than 30°, with respect to the base body 2. Furthermore, the spring parts 3.1-3.8 or tongues also have a further, third extent section which is referred to by the reference symbol 3.8*c* in FIG. 1. The third extent section 3.8*c* adjoins the second extent section 3.8*b*; in said section the spring part 3.1-3.8 is bent to a greater degree from the base body 2 than in the second extent section 3.8*b*. Furthermore, it is noticeable that the spring part 3.1-3.8 in the third extent section 3.8*c* is in certain areas widened in comparison with the second extent section 3.8*b*. According to the configuration in FIG. 1, this widening, which is provided with the reference symbol 3.8*d*, is arranged in the end at a free end of the third extent section 3.8*c*. Furthermore, the spring part 3.1-3.8 in the second extent section 3.8*b* also has a widening in certain areas, referred to by the reference symbol 3.8*e* in FIG. 1. It has already been pointed out that the spring parts 3.1-3.8 or the tongues differ with respect to a length of the third extent section 3.8*c*, as is also apparent from the illustration in FIG. 3 and, in particular, from the illustration in FIG. 4.

With reference to FIG. 2, more precise details will now be given on the configuration of the anchoring parts 4.1-4.6. Each of the anchoring parts 4.1-4.6 is embodied as a tongue which projects from the base body 2 in an edge region of the base body, wherein, as illustrated, the anchoring part tongues project from one edge of the base body 2, which edge is opposite that edge of the base body 2 from which the spring part tongues project. As designated by way of example, by the anchoring part 4.6 in FIG. 2, each anchoring part 4.1-4.6 has a first extent section 4.6*a* which adjoins the abovementioned edge region, and a second extent section 4.6*b* which adjoins the first extent section 4.6*a*. In this context, the respective tongue (anchoring part 4.6) in the first extent section 4.6*a* extends away from the base body 2, approximately perpendicularly with respect thereto, and in the second extent section 4.6*b* it extends back again to the base body 2, so that an angle $\alpha<90°$, $\alpha\approx45°$, is enclosed between the abovementioned extent sections 4.6*a*, 4.6*b*, as illustrated in FIG. 2. Furthermore, the anchoring part tongues 4.1-4.6 have an incision or a notch 4.6*c* at their free edge at the end, so that an approximately dovetail-shaped appearance is produced. As becomes clear when considering FIG. 2, the anchoring parts 4.1-4.6 differ in terms of a dimension of the first extent section 4.6*a*, where the connecting element 1 always alternately has an anchoring part 4.1, 4.3, 4.5 with a relatively short first extent section 4.6*a* and an anchoring part 4.2, 4.4, 4.6 with a relatively long first extent section 4.6*a*.

In FIG. 2, the reference symbol B denotes an effective width of the anchoring parts 4.1-4.6.

It is important with the connecting elements 1 described above in conjunction with FIGS. 1-4, and common to them, that an engagement direction of the anchoring part or of the anchoring parts 4.1-4.6, that is to say a direction in which the respective anchoring parts 4.1-4.6 are introduced into a slot-shaped recess in the sink, extends essentially approximately antiparallel with respect to a direction of the spring force, which spring force results if the spring parts 3.1-3.8 are loaded in the direction of the base body 2. More precise details are given on this below; however, this situation can also be seen well in FIG. 3 which is selected by way of example: If according to the configuration of the connecting element 1 according to FIG. 3 the spring parts 3.1-3.8 are pressed inward in the direction of the base body 2, a spring force results which is oriented essentially directly perpendicularly away from the base body 2 of the connecting element 1. A minor deviation results only due to the slightly oblique profile of the spring part tongues with respect to the base body 2. In contrast, the anchoring parts 4.1-4.6 project essentially perpendicularly from the rear side of the base body 2, as can also be seen well in FIG. 2. This direction of projection of the anchoring parts 4.1-4.6 with respect to the base body 2 corresponds essentially to the engagement direction mentioned above. In this way, the engagement direction of the anchoring part or of the anchoring parts 4.1-4.6 extends essentially approximately antiparallel with respect to the direction of the spring force. As already mentioned, more precise details will be given on this further below, in particular with reference to FIGS. 10 and 11.

Figure 5:
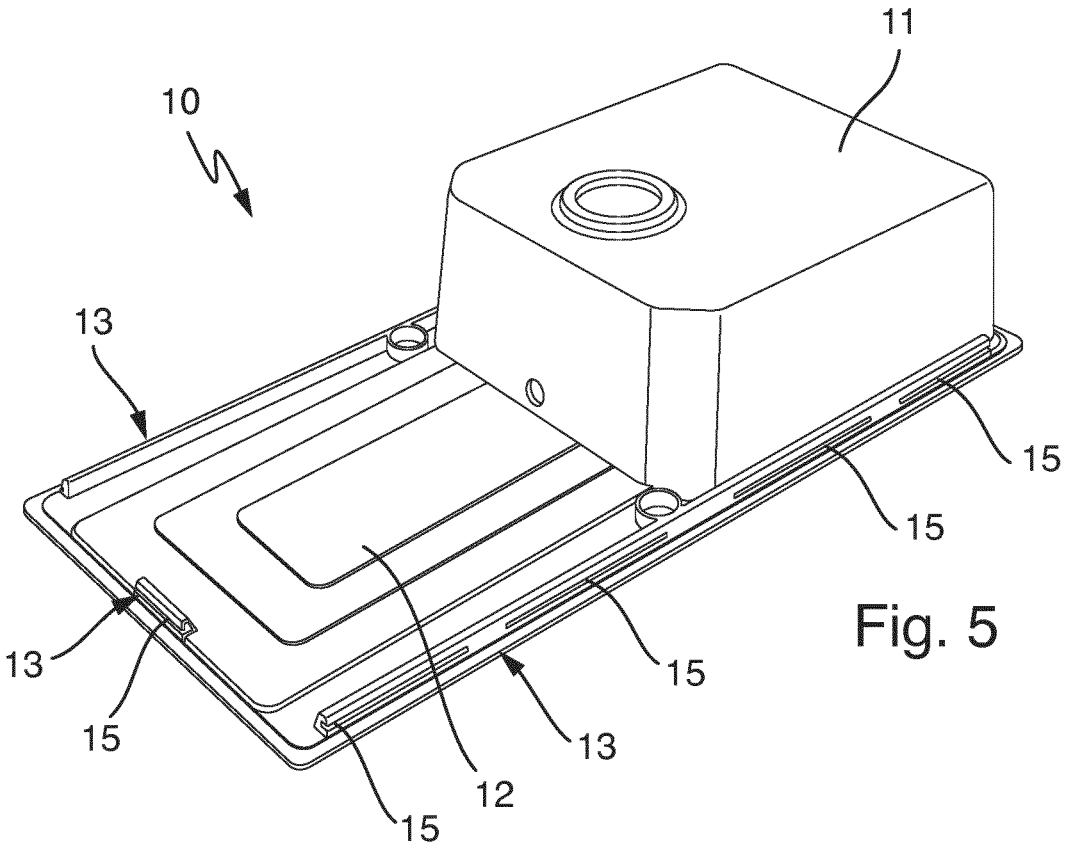
FIG. 5 shows a perspective view of the underside of a sink in which a connecting element according to the invention can be used.

FIG. 5 shows a perspective overall view of the underside of a kitchen sink 10 which is manufactured from a plastic or mineral molded material or a corresponding composite material. The sink 10 has, for example, a kitchen sink 11 and a draining area 12 which is arranged next to the kitchen sink 11, without the invention being limited thereto. In edge areas on the underside of the sink, the sink 10 preferably has anchoring and bearing structures which are positioned at the edge, are connected integrally to the rest of the sink and are provided with the reference symbol 13 in FIG. 5. More precise details on the precise configuration thereof will be given below with reference to FIG. 7 et seq.

Figure 6:
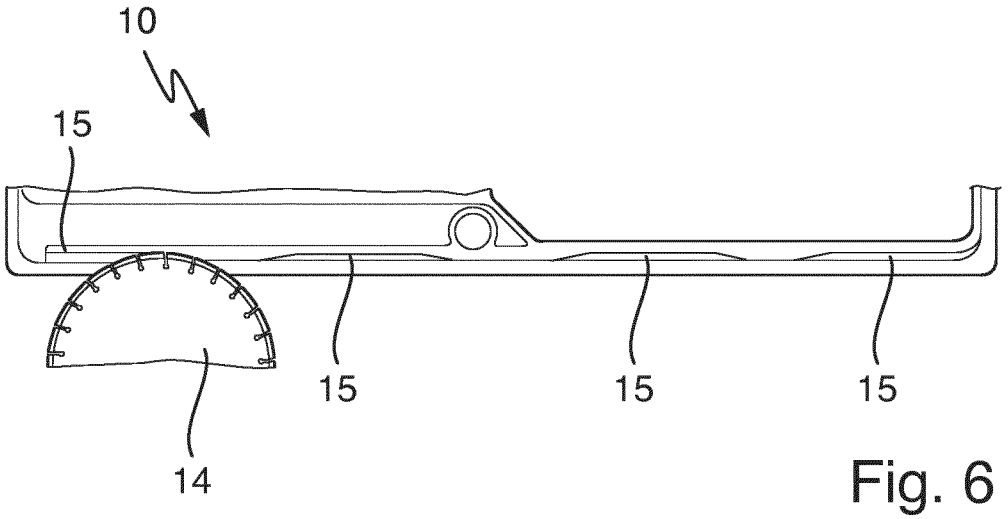
FIG. 6 shows part of the sink from FIG. 5 for illustrating a processing method in this respect.

FIG. 6 illustrates schematically how a slot-shaped recess is provided in the region of the abovementioned anchoring and bearing structures 13 using a suitable tool, preferably a cutting disk 14 fitted with diamonds, said recess extending at least over certain longitudinal regions of the anchoring and bearing structure 13. Such slot-shaped recesses can be seen with the reference symbol 15 in FIG. 5.

Figure 7:
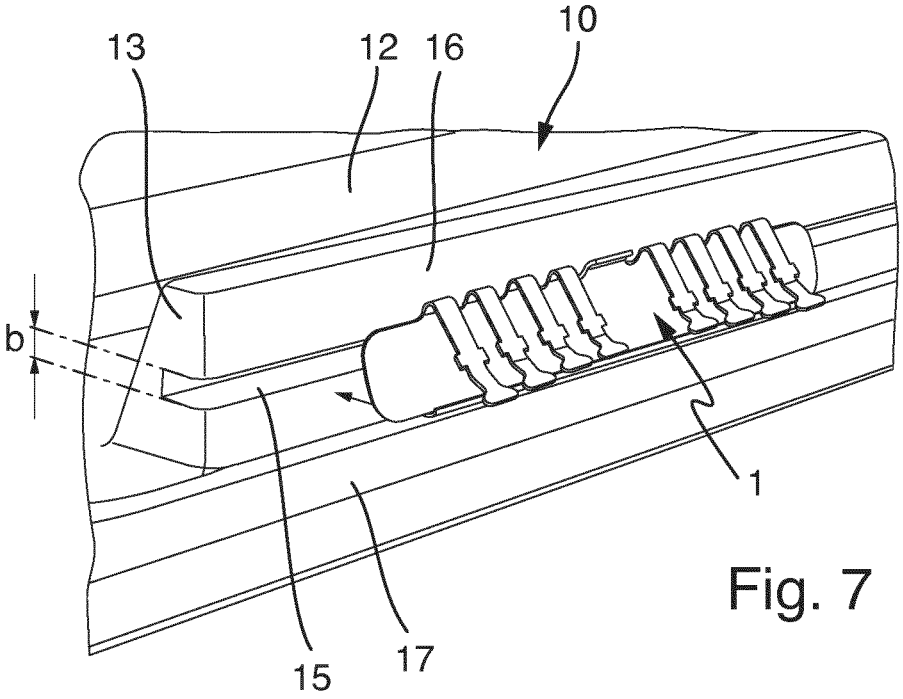
FIG. 7 shows a detail of the sink from FIG. 5 in conjunction with a connecting element according to the invention.

FIG. 7 shows a more detailed illustration of such an anchoring and bearing structure 13 which is positioned at the edge and has a slot-shaped recess 15 on the underside of the sink 10. The slot-shaped recess 15 has a width b which is sufficient to engage the connecting element 1, by its anchoring parts 4.1-4.6 (cf. FIG. 2), with the slot-shaped recess 15. In this context, the following preferably applies: B>b, so that the connecting element 1 experiences deformation in the region of the anchoring parts 4.1-4.6 when said connecting element 1 is introduced into the recess 15 (associated with an absolute decrease in the angle $\alpha$; cf. FIG. 2), as a result of which the connecting element 1 is securely held in the recess 15. This is assisted by the dovetail-like configuration of the anchoring parts 4.1-4.6, to which reference has already been made above. The anchoring parts 4.1-4.6 can effectively dig into the sink material with the points in the region of their free edge at the end, so that the connecting elements 1 can no longer be readily removed from the sink 10.

Figure 8:
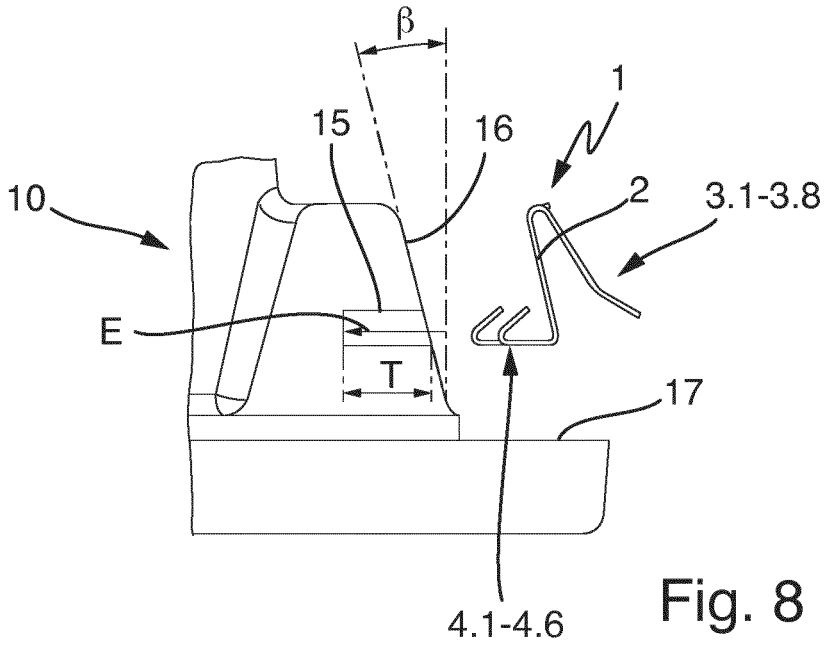
FIG. 8 shows a different illustration of the contents of FIG. 7.
Figure 9:
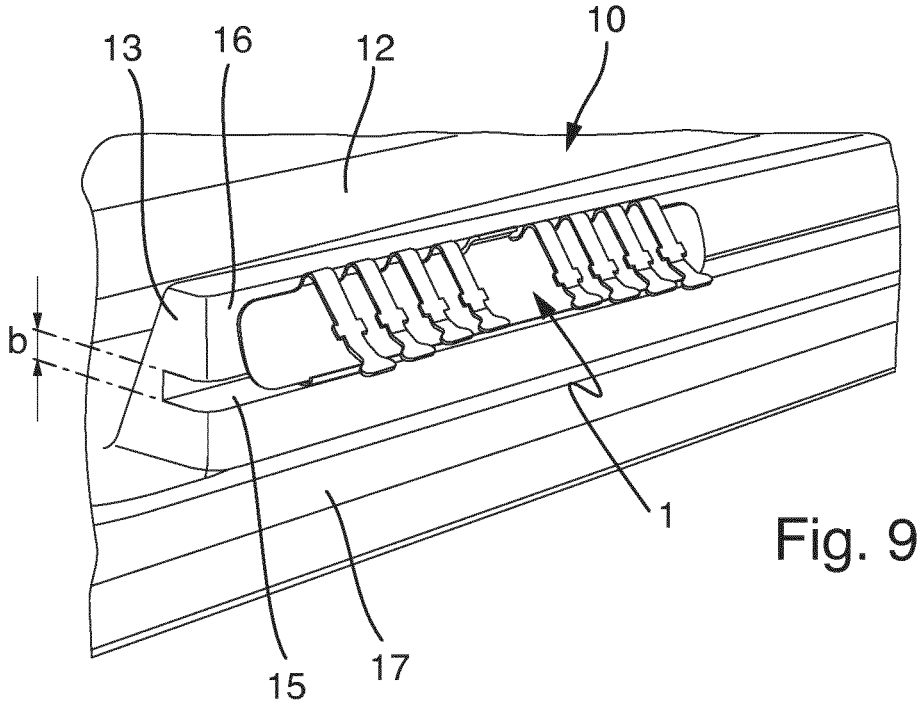
FIG. 9 shows a detailed illustration of a combination of sink and connecting element according to the invention.

FIG. 8 illustrates in more detail the process of the engagement with one another of the connecting element 1 and the sink 10 in the region of the recess 15 of the anchoring and bearing structure 13 positioned at the edge. The connecting element 1 is pressed, with its anchoring parts 4.1-4.6, into the slot-shaped recess 15 in the direction of the arrow, as already described. In this context it is necessary to form the recess 15 sufficiently deep in terms of its depth T for the anchoring parts 4.1-4.6 to be able to be introduced completely into the recess 15 until the connecting element 1 enters into abutment with its base body 2 against an outer bearing face 16 of the anchoring and bearing structure 13, which base body 2 is, according to the specifications, also embodied as a bearing part for bearing against the sink 10. As is also apparent from FIG. 8, according to the exemplary embodiment shown the bearing face 16 does not extend precisely at an angle of approximately 90° with respect to a bearing edge 17 of the sink 10 but rather at an angle $90°-\beta$, where $\beta$ can be approximately 15°. This corresponds to a geometric configuration of the connecting element 1 which relates to the angle between the anchoring parts 4.1-4.6 and the base body 2, as illustrated in FIG. 8. In this way, the connecting element 1 can be moved into abutment with its base body 2 over an entire surface against the bearing face 16 of the anchoring and bearing structure 13, as is illustrated by FIGS. 9 and 10.

Figure 10:
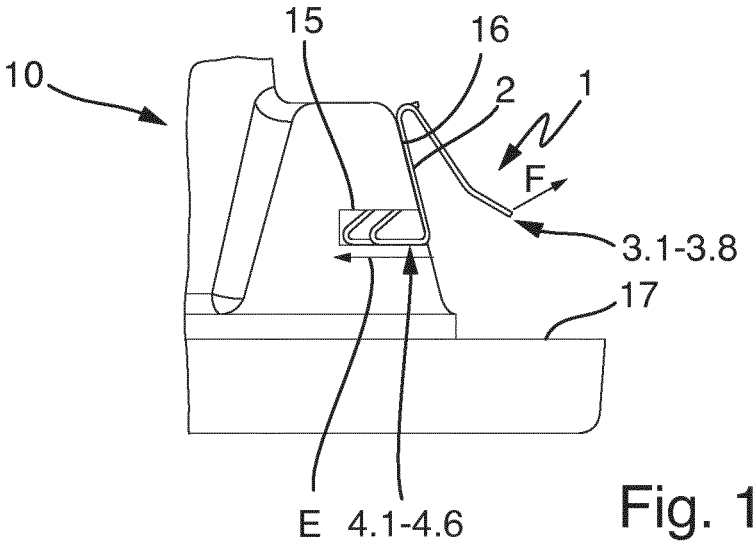
FIG. 10 shows a different illustration of the contents of FIG. 9.

The situation according to which the engagement direction E of the anchoring parts 4.1-4.6 extends essentially approximately antiparallel with respect to a direction of the spring force is also illustrated schematically in FIG. 10—said spring force being symbolized by an arrow F in FIG. 10. It is particularly advantageous here that the loading of the spring parts 3.1-3.8 in the direction of the base body coincides effectively with the engagement direction of the anchoring parts 4.1-4.6, which contributes to optimum seating of the connecting elements 1 on the sink 10.

Figure 11:
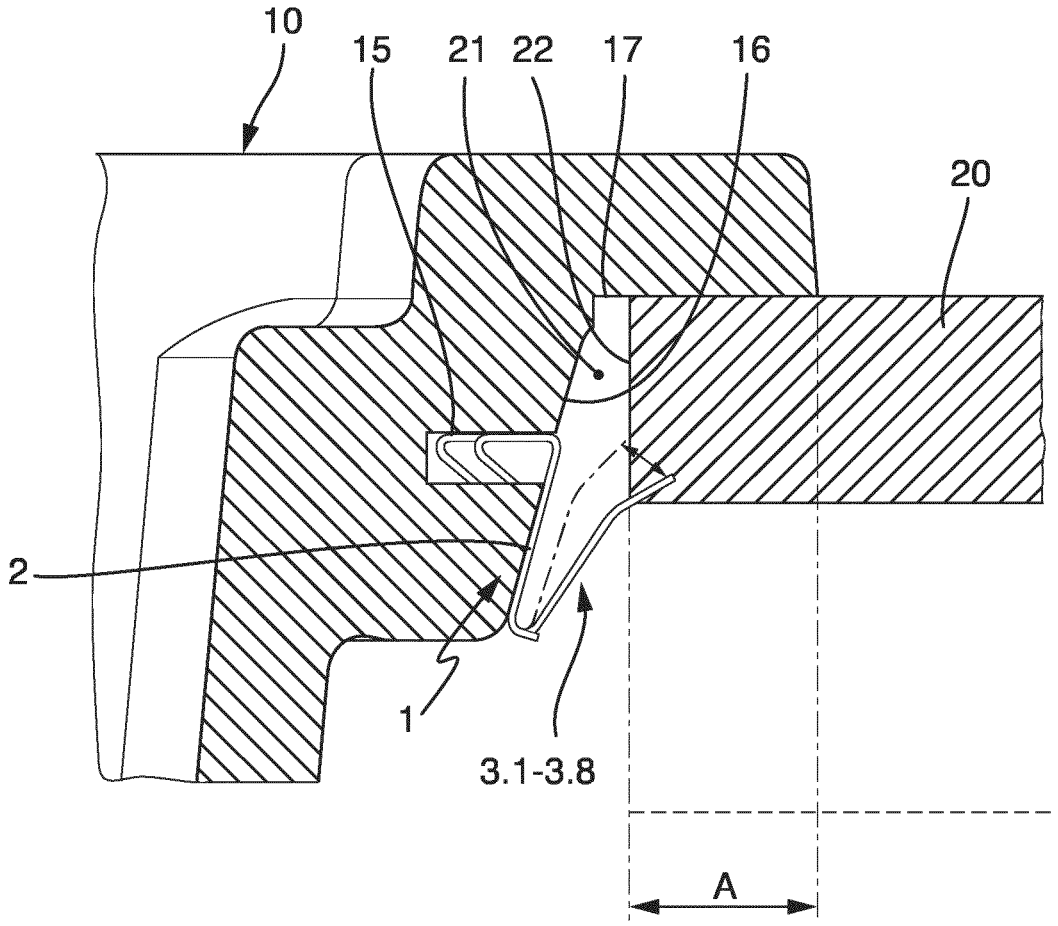
FIG. 11 shows a cross-sectional view of an installation of the sink in combination with a connecting element on a worktop.

FIG. 11 finally illustrates an installation situation of the sink 10 in combination with a connecting element 1 on a worktop 20. The worktop has a cutout 21 for inserting the sink 10, which cutout 21 has a peripheral boundary face 22. The connecting element 1 interacts with this boundary face 22 in the region of the free end, as illustrated (reference symbol 3.8*d*, cf. FIG. 1, FIG. 3). The spring parts 3.1-3.8 are deformed in the direction of the base body 2 of the connecting element 1, so that a restoring force (spring force)

which counteracts the deformation is produced away from the base body 2, as a result of which the sink 10 is secured to or in the worktop 20. The different embodiment of the spring parts 3.1-3.8 supports the securing effect and ensures there is a certain compensation of tolerances. The overlapping region of the bearing edge 17 of the sink 10 and the worktop 20 defines a sealing region, which is denoted by the reference symbol 23 in FIG. 11. In this region the sink 10 is preferably sealed with respect to the worktop 20 using silicone (silicone adhesive) which can be applied to the sink 10 and/or the worktop 20 at the installation location. Due to the deformability of the spring parts 3.1-3.8, a tolerance of preferably approximately ±3 mm arises for the dimensioning of the worktop cutout 21. A thickness of the worktop is preferably at least approximately 12 and at most approximately 50 mm. The worktop 20 can be produced from all customary materials, in particular from wood, stone or suitable composite materials. Finally, the minimum thickness of the worktop 20 is bounded in the downward direction only by the fact that a secure interaction between the spring parts 3.1-3.8 and worktop 20 has to take place, as illustrated in FIG. 11.

The invention claimed is:

1. A connecting element (1) for fastening a sink (10) to a worktop (20), the worktop (20) has a cutout (21) for inserting the sink (10), and the cutout (21) has a peripheral boundary face (22), the connecting element (1) comprising:

a base body (2) which serves as a bearing part for bearing against the sink (10);

at least one spring part (3.1-3.8) which projects from the base body (2) on a first side and which is configured to bring about a spring force (F) which acts away from the base body (2), when there is loading in a direction of the base body (2); and at least one anchoring part (4.1-4.6) which projects from the base body (2) on a second side thereof lying opposite the first side, the at least one anchoring part is configured to engage in a slot-shaped recess (15) in the sink (10);

wherein an engagement direction (E) of the anchoring part (4.1-4.6) extends essentially approximately anti-parallel with respect to a direction of the spring force (F);

the anchoring part (4.1-4.6) is embodied as a tongue which projects from the base body (2) in an edge region of the base body (2) and which has a first extent section (4.6*a*) which adjoins the edge region, and a second extent section (4.6*b*) which adjoins the first extent section, wherein the tongue in the first extent section (4.6*a*) extends away from the base body (2), approximately perpendicularly with respect thereto, and in the second extent section (4.6*b*) extends back again to the base body (2); and a multiplicity of anchoring parts (4.1-4.6) are provided which differ with respect to at least one of an angle (α) between the first extent section (4.6*a*) and the second extent section (4.6*b*) or with respect to a dimension of the first extent section (4.6*a*).

2. The connecting element (1) as claimed in claim 1, wherein an angle between the engagement direction (E) and the direction of the spring force (F) is at least approximately 135 degrees.

3. The connecting element (1) as claimed in claim 1, wherein the spring part (3.1-3.8) is embodied as a tongue which projects from the base body (2) in an edge region of the base body (2) and has a first extent section (3.8*a*) adjoining the edge region and a second extent section (3.8*b*) adjoining the first extent section, wherein the tongue in the first extent section (3.8*a*) extends approximately perpendicularly with respect to the base body (2), and in the second extent section (3.8*b*) extends approximately parallel to or at an acute angle of less than 45 degrees with respect to the base body (2).

4. The connecting element (1) as claimed in claim 3, wherein the spring part (3.1-3.8) has a further, third extent section (3.8*c*) which adjoins the second extent section (3.8*b*) and in which the spring part (3.1-3.8) is angled to a greater extent from the base body (2) than in the second extent section (3.8*b*).

5. The connecting element (1) as claimed in claim 4, wherein the spring part (3.1-3.8) is widened in the third extent section (3.8*c*) at least in certain areas with respect to the second extent section (3.8*b*).

6. The connecting element (1) as claimed in claim 3, wherein the spring part (3.1-3.8) has a widened portion (3.8*e*) at least in certain areas in the second extent section (3.8*b*).

7. The connecting element (1) as claimed in claim 3, wherein a multiplicity of the spring parts (3.1-3.8) are provided which differ with respect to the angle between the base body (2) and the tongue in the second extent section (3.8*b*).

8. The connecting element (1) as claimed in claim 1, wherein the tongue of the anchoring part has an incision or a notch (4.6*c*) at a free edge thereof positioned at an end.

9. The connecting element (1) as claimed in claim 1, wherein the connecting element is a punched-bent part or a laser cut part formed from a metallic material.

10. The connecting element (1) as claimed in claim 1, further comprising at least one clip (5.1, 5.2) which projects over a remainder of the base body (2) provided on the base body (2).

11. The connecting element (1) as claimed in claim 1, further comprising at least one breakthrough (6.1, 6.2) provided in the base body (2).

12. A combination of a sink (10) and at least one connecting element (1) arranged on the sink (10) for fastening the sink (10) to a worktop (20), the worktop (20) has a cutout (21) for inserting the sink (10), and the cutout (21) has a peripheral boundary face (22), the connecting element comprising:

a base body (2) which serves as a bearing part for bearing against the sink (10);

at least one spring part (3.1-3.8) which projects from the base body (2) on a first side and which is configured to bring about a spring force (F) which acts away from the base body (2), when there is loading in a direction of the base body (2); and at least one anchoring part (4.1-4.6) which projects from the base body (2) on a second side thereof lying opposite the first side, the at least one anchoring part is configured to engage in a slot-shaped recess (15) in the sink (10);

wherein an engagement direction (E) of the anchoring part (4.1-4.6) extends essentially approximately anti-parallel with respect to a direction of the spring force (F);

the anchoring part (4.1-4.6) is embodied as a tongue which projects from the base body (2) in an edge region of the base body (2) and which has a first extent section (4.6*a*) which adjoins the edge region, and a second extent section (4.6*b*) which adjoins the first extent section, wherein the tongue in the first extent section (4.6*a*) extends away from the base body (2), approximately perpendicularly with respect thereto, and in the second extent section (4.6*b*) extends back again to the base body (2); and a multiplicity of anchoring parts (4.1-4.6) are provided which differ with respect to at least one of an angle (a) between the first extent section (4.6*a*) and the second extent section (4.6*b*) or with respect to a dimension of the first extent section (4.6*a*).

13. The combination as claimed in claim 12, wherein the sink (10) has, at least on a mounting underside thereof, at least one anchoring and bearing structure (13) positioned on an edge and having a bearing face (16) which extends at an angle of approximately 90 degrees with respect to a bearing edge (17) of the sink (10), and the slot-shaped recess (15) is in the bearing face (16), extends parallel to the bearing edge (17) and is configured for receiving the anchoring part (4.1-4.6).

14. The combination as claimed in claim 13, wherein the connecting element (1) bears with the base body (2) against the bearing face (16) when the anchoring part (4.1-4.6) is received in the recess (15), and the spring part (3.1-3.8) projects outward away from the sink (10).

15. The combination as claimed in claim 14, wherein at least one of the anchoring and bearing structure (13) is configured with a frustum-shaped cross section or the anchoring and bearing structure (13) is provided on both long sides or short sides of the sink (10), or both.

16. The combination as claimed in claim 12, wherein the sink (10) is produced from a plastic molded material, a mineral mold material or a corresponding composite material.

17. The combination as claimed in claim 12, further comprising the worktop (20) having the cutout (21) for inserting the sink (10), the cutout (21) has the peripheral boundary face (22), and the connecting element (1) interacts with the spring part (3.1-3.8) on the boundary face (22) in order to attach the sink (10).

* * * * *